United States Patent [19]

Peppler

[11] 3,931,891

[45] Jan. 13, 1976

[54] PILL CONTAINER WITH POCKET

[76] Inventor: Stanley R. K. Peppler, Rte. 5, Paris, Tex. 75460

[22] Filed: Oct. 11, 1974

[21] Appl. No.: 514,316

[52] U.S. Cl. ..... 206/538; 215/6; 215/222; 220/298

[51] Int. Cl.[2] ..... B65D 83/04; B65D 41/06

[58] Field of Search ..... 206/538, 540; 220/20, 90.2, 220/90.4; 215/6, 222, 223

[56] References Cited

UNITED STATES PATENTS

| | | | |
|---|---|---|---|
| 132,020 | 10/1872 | Odell | 215/6 |
| 674,989 | 5/1901 | Ritz | 215/6 |
| 1,100,298 | 6/1914 | Haas | 220/20 UX |
| 2,233,160 | 2/1941 | Eisen | 215/6 UX |
| 2,493,922 | 1/1950 | Miller | 215/6 |
| 2,766,796 | 10/1956 | Tupper | 150/.5 |
| 2,940,447 | 6/1960 | Zanegood | 215/6 UX |
| 3,367,484 | 2/1968 | Nelson | 215/6 |
| 3,613,928 | 10/1971 | Landen | 215/222 X |

*Primary Examiner*—Leonard Summer
*Attorney, Agent, or Firm*—Cushman, Darby & Cushman

[57] ABSTRACT

The invention relates to a container with a pocket for holding pills and the like. A pocket member is formed within a container and is adapted to hold a number of pills or the like being held by the main body of the container. This allows an individual to separate out a daily dosage of pills in the pocket from the rest of the pills in the container in order to facilitate prevention of taking two few or too many pills. A single cap may close both the pocket and the main body of the container.

7 Claims, 3 Drawing Figures

PILL CONTAINER WITH POCKET

BACKGROUND AND SUMMARY OF THE INVENTION

The invention relates to a container for material formed of discrete portions, and a pocket member formed within the container for holding a number of the discrete portions separate from the rest of the material being held by the container. There are many showings in the prior art of containers having pockets formed therein for holding a material different from the material held by the main body of the container (see U.S. Pat. Nos.: 3,154,219, 2,493,922, 2,766,796, 2,362,223, 1,768,771, 674,989, 1,994,525 and 2,940,447 for example), however there are no known prior art devices adapted for holding the same material in a pocket member as is held in the main body of the container.

According to the present invention, a main container body has a pocket formed therein for receipt of the same material discrete portions held by the main container body to thereby separate them from the main container body. Such a device is particularly useful as a pill container. The great number of the pills held by the container are held within the main body portion, however the pocket is provided to allow an individual required to take the pills to separate out the number of pills that should be taken per unit time (i. e., daily) from the rest of the container, so that the individual will be able to keep accurate track of how many pills have been taken and how many remain to be taken.

According to the preferred aspect of the present invention, the pocket member is so located with respect to the main container body that the cap for closing the main container body will also prevent spillage of pills from the pocket member to the main body portion, the cap being spaced a distance from the top of the pocket member less than the smallest dimension of the pills held by the container.

It is thus the primary object of this invention to provide an improved container for allowing separation of discrete portions of material held thereby. This and other objects of the invention will become clear from the detailed description of the invention and the appended claims.

DETAILED DESCRIPTION OF THE INVENTION

Figure 1:
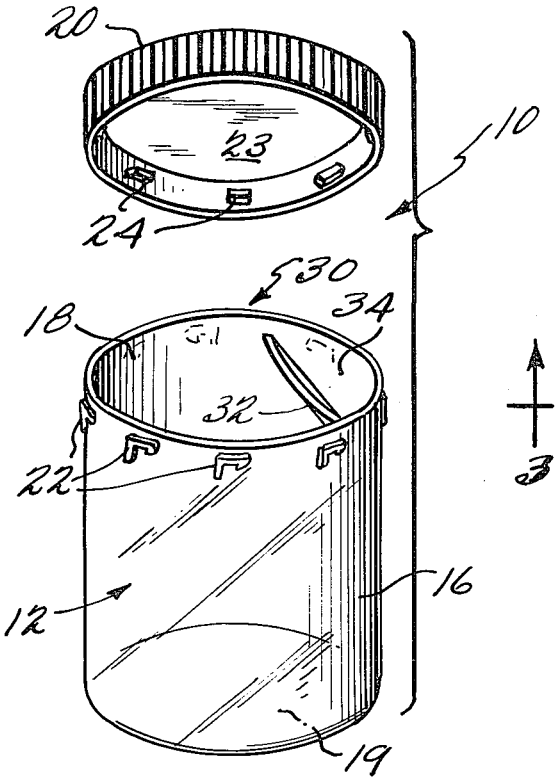
FIG. 1 is a perspective view of an exemplary container and cap according to the present invention shown in their disassembled position.
Figure 2:
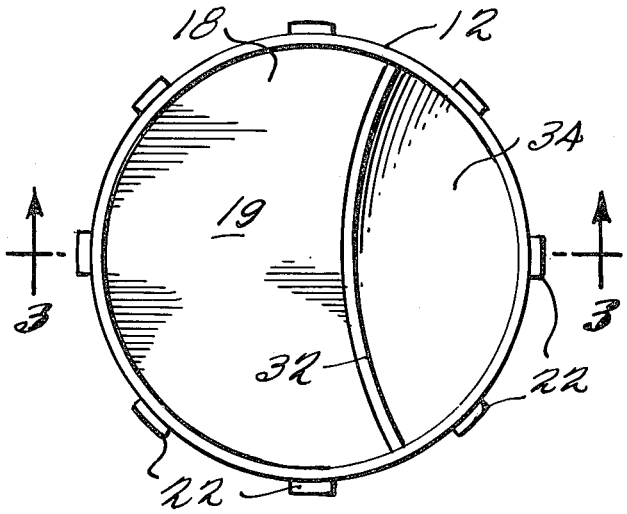
FIG. 2 is a top plan view of the container shown in FIG. 1.

An exemplary container and cap assembly according to the invention is shown generally at 10 in FIG. 1. The container has a main body member shown generally at 12 having a closed bottom 14 and closed side portions 16, and an open top 18. The container main body member 12 may be of any desired shape and size, and may be specially adapted to hold any particular material formed of discrete portions. The body member 12 may also be constructed of any material suitable for holding the material which is to be held by the container, but when the container is to be used to hold pills it is preferred that it be formed of a transparent material such as plastic or glass. The main body member has a cap 20 therefor adapted to close the open top 18 thereof to prevent spillage of discrete material portions from the body member 12. Any suitable means may be provided to secure the cap 20 to the member 12, however, it is preferred that when the container is used to hold pills or the like, to prevent access to the container by small children particular latching projections 22 and 24 on the body member and cap respectively be provided whereby a depress and twist motion is necessary to remove the cap 20 from the member 12. Other suitable safety latches or other securing means in general can of course be provided.

Formed within the main body member 12 is a pocket member, shown generally at 30 in the drawings. Although the pocket member may also be of any size, shape, and material it preferably is of the same material as the main body member 12, defines a volume considerably smaller than the member 12, and is formed of a single integral piece cooperating with the member 12. As shown in the drawings, the single piece 32 is a curved member attached along the side and bottom portions thereof to the side 16 of the main body member 12, and has an open top 34. The volume enclosed thereby is large enough to hold a desired number of discrete portions of the material held by the container, such as a daily dosage of pills.

Figure 3:
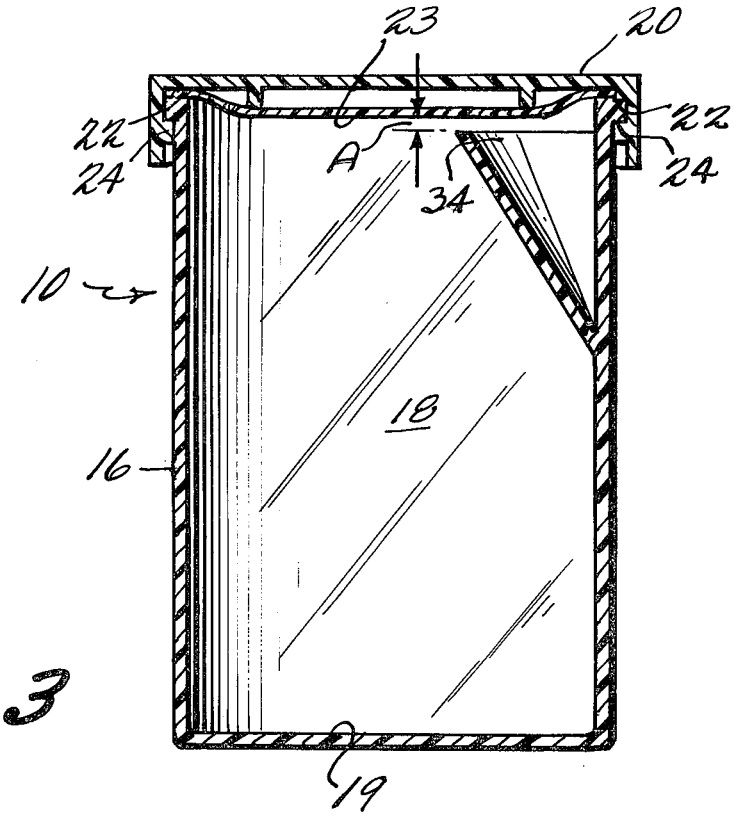
FIG. 3 is a cross-sectional view taken along lines 3—3 of FIG. 2 showing the cap and main body member in assembled relationship.

As shown in FIG. 3, when the cap 20 is assembled with the main body member 12, it is preferred that the interior face 23 of the cap 20 is spaced a distance A from the open top of the pocket member 30 wherein the distance A is less than the smallest dimension of the discrete portions adapted to be held by the pocket and container. This is to insure that the pills or other discrete portions held by the pocket 30 will not spill back into the main body member 12 no matter what the orientation thereof, and that other pills from the main body 12 will not enter the pocket 30. Of course other means could be provided for ensuring separation of the interior of the pocket 30 from the container while still allowing access thereto — such as a separate removable cap for the pocket 30 — however a single cap 20 for performing both the functions of selectively closing the main body member and the pocket member is preferred since it allows ready adaptation of existing pill containers to form containers according to the present invention, and involves a minimum number of parts and therefore a minimum of expense and trouble in the manufacture thereof.

A typical operation of the container shown in the drawings will now be set forth: A number of pills or the like are deposited into the main body member 12 of the container 10. Each day (or other selected time period) an individual takes the predetermined number of pills prescribed to be taken for that day from the member 12 and places them into the pocket 30. The individual can now keep track of how many pills he has taken or has yet to take since a fail-safe visual indication will be provided. In this way the individual can be sure that he does not take too many or too few pills, and thereby avoid the adverse consequences that could ensue therefrom. Placing cap 20 on member 12 ensures that pills from the pocket 30 will not be inadvertently spilled into the member 12 and vice versa.

While the invention has been herein shown and described in what is presently conceived to be the most practical and preferred embodiment, it will be obvious to one of ordinary skill in the art that many modifications may be made thereof within the scope of the invention. For instance, the pocket 30 could be of any shape and orientation with respect to the main body member, depending upon the material to be held and the environment in which it will be used. Many other modifications are also possible, thus the invention should be given the broadest interpretation of the appended claims so as to encompass all equivalent structures and devices.

What is claimed is:

1. A container for holding a plurality of discrete elements of predetermined dimensions therein, said container comprising a. a main body member, said member having closed side and bottom portions and an open top and holding a plurality of said discrete elements therein, b. a cap for closing the open top of said main body member, c. a pocket member formed in said main body member, said pocket member having closed bottom and side portions and an open top and holding a plurality of said discrete elements therein separate from said plurality of said discrete elements held by said main body member, said pocket member being so located within said main body member that the open top of said pocket member is spaced from said cap when said cap closes the top of said main body member a distance less than said predetermined dimensions of said discrete elements so that elements from said pocket may not mix with elements in said main body member and vice-versa.

2. A container as recited in claim 1 wherein said main body member is a pill bottle and wherein said discrete elements are pills and said pocket member holds a number of pills corresponding to the number of pills that should be taken by an individual during a certain period of time.

3. A container as recited in claim 2 wherein a number of safety latching projections are formed on the outside perimeter of said body member and corresponding safety latching members are formed on the interior of said cap.

4. A container as recited in claim 3 wherein said safety projections require that said cap be depressed and twisted before it may be removed from said main body member.

5. A container as recited in claim 1 wherein said main body member and said pocket member are formed of plastic.

6. A container as recited in claim 1 wherein said pocket member is formed by a curved side portion of said main body member and a single sheet member attached along the side and bottom peripheries thereof to said curved side portion.

7. A container as recited in claim 1 wherein said pocket member is formed by an integral sheet of the same material that forms said body member, and wherein said sheet is secured around the bottom and side edges thereof to a side portion of said main body member.

* * * * *